United States Patent [19]

Obara

[11] Patent Number: 4,461,583

[45] Date of Patent: Jul. 24, 1984

[54] ALARM ELECTRONIC TIMEPIECE HAVING A STEPPING MOTOR

[75] Inventor: Nobuo Obara, Tokyo, Japan

[73] Assignee: Seiko Instruments & Electronics Ltd., Tokyo, Japan

[21] Appl. No.: 284,965

[22] Filed: Jul. 20, 1981

[30] Foreign Application Priority Data

Aug. 20, 1980 [JP] Japan ..... 55-114164

[51] Int. Cl.[3] ..... G04B 23/00

[52] U.S. Cl. ..... 368/260; 368/72; 368/259

[58] Field of Search ..... 368/72, 73, 76, 157, 368/160, 259, 260, 250

[56] References Cited

U.S. PATENT DOCUMENTS 4,244,041 1/1981 Vermont ..... 368/73

4,261,050 4/1981 Stampfli ..... 368/259

4,303,997 12/1981 Saito ..... 368/259

*Primary Examiner*—Bernard Roskoski

*Attorney, Agent, or Firm*—Robert E. Burns; Emmanuel J. Lobato; Bruce L. Adams

[57] ABSTRACT

In an alarm electronic timepiece having a reference time generator, a normal hand stepping pulse generator for driving a stepping motor, an alarm coincidence circuit and an electric buzzer, it includes an alarm hand stepping pulse generator which produces an alarm hand stepping pulse to drive the stepping motor instead of the normal hand stepping pulse from the normal hand stepping pulse generator, in an alarm sound generating state. The alarm hand stepping pulse produces at the lowest alarm sound pressure of the electronic buzzer, whereby a highly reliable and acoustically excellent alarm electronic timepiece is provided.

4 Claims, 6 Drawing Figures

ALARM ELECTRONIC TIMEPIECE HAVING A STEPPING MOTOR

BACKGROUND OF THE INVENTION

The present invention relates to an alarm electronic timepiece for displaying time by an hour hand, minute hand and second hand, and more particularly to an alarm electronic timepiece having means for preventing mis-operation of the stepping motor caused by a drop in the battery voltage when an alarm sound is being generated.

The conventional alarm electronic timepiece having an hour hand, minute hand and second hand is provided with an electronic buzzer serving as a sound generating means and a stepping motor serving as a hand stepping means. Since the electronic buzzer consumes a comparatively large current of several to ten several mA in the sound generating state, the terminal voltage of the battery drops under the influence of the internal resistance of the battery. If the stepping motor is driven in this condition, there is the likelihood that the stepping motor will mis-operate and cease stepwise rotation. Therefore it is necessary to shift the signal for driving the electronic buzzer from the signal for driving the stepping motor (hereafter referred to as a hand stepping pulse) beforehand or it is necessary to prohibit the electronic buzzer driving signal when both signals come into conflict and occur at the same moment. The former method is effective in the case of a single sound which is regularly repeated, however, it is not effective in the case of a dampened sound of comparatively long period which is irregularly repeated as shown in FIG. 1. In the latter method, the alarm sound as shown in FIG. 1 is periodically interrupted so that the desired sound would not be produced if the buzzer driving signal were inhibited at each occurrence of the hand stepping pulse.

SUMMARY OF THE INVENTION

The present invention aims to eliminate the above-noted drawbacks and disadvantages, and therefore it is an object of the present invention to eliminate variations in the intended alarm sound of the type shown in FIG. 1 caused by the conflict or competition of both the hand stepping pulse and the electronic buzzer driving signal, by changing over the former to be synchronized with the latter in the alarm sound generating state, whereby a highly reliable and acoustically excellent alarm electronic timepiece is provided.

It is another object of the present invention to provide an alarm electronic timepiece having a reference time generator, a normal hand stepping pulse generator to provide a normal hand stepping pulse to a stepping motor and connected to the reference time generator, a time counter connected to the reference time generator, an electronic buzzer for producing an alarm sound, an alarm hand stepping pulse generator for providing an alarm hand stepping pulse to the stepping motor instead of the normal hand stepping pulse in response to an output signal from an alarm coincidence circuit, and an alarm composing circuit for driving an electronic buzzer in response to the output signal from the alarm coincidence circuit.

DESCRIPTION OF THE PREFERRED EMBODIMENTS

Hereinafter the present invention will be illustrated in conjunction with the drawings.

Figure 1:
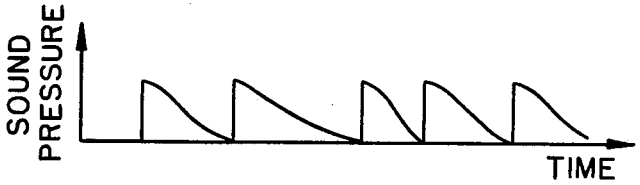
FIG. 1 is an explanatory graph showing an example of an alarm sound pressure which varies irregularly with the passage of time.
Figure 2:
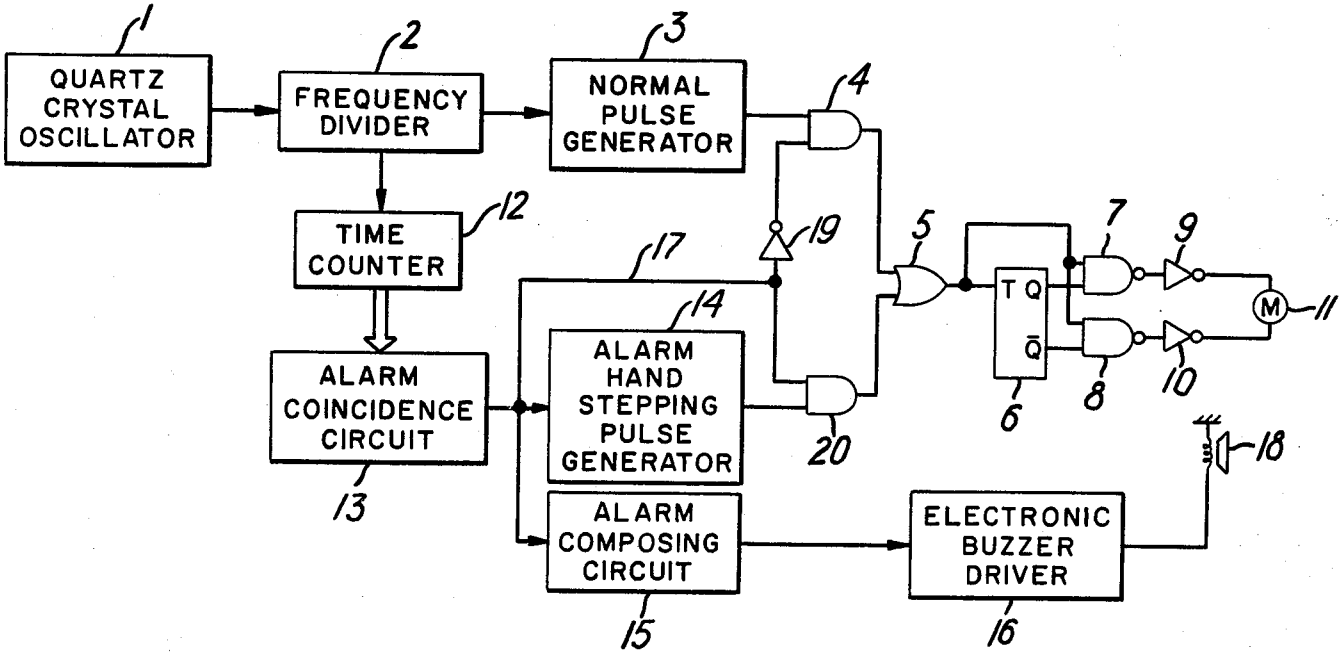
FIG. 2 shows a circuit block diagram of an alarm electronic timepiece embodying the present invention.

FIG. 2 shows a circuit block diagram of an alarm electronic timepiece according to the present invention. In the normal state (the nongenerating state of the alarm sound), a signal generated from a quartz crystal oscillator 1 is divided into a 1 Hz signal by a frequency divider 2 and the 1 Hz signal is fed to a normal hand stepping pulse generator 3 for composing a hand stepping pulse signal in the normal state (sometimes referred to hereafter as the normal drive pulse or normal hand stepping pulse). The normal hand stepping pulse is fed through an AND gate 4 and an OR gate 5, and through a NAND gate 7 or 8 according to the output condition of a flip-flop TFF 6, and fed to a motor driver 9 or 10 to thereby drive a stepping motor 11. Further FIG. 2 includes a time counter 12 for counting the present time or other display information in accordance with an output from the frequency divider 2, an alarm coincidence circuit 13 for detecting the coincidence of a preset alarm time in response to an output from the time counter 12 and producing a corresponding alarm output signal, an alarm hand stepping pulse generator 14 for composing a hand stepping pulse in the alarm sound generating state (sometimes referred to hereafter as the alarm drive pulse or alarm hand stepping pulse), an alarm composing circuit 15 for composing a buzzer driving signal for driving an electronic buzzer 18, and an electronic buzzer driver 16 to receive the output from the alarm composing circuit. When the coincidence of the alarm time is detected by the alarm output signal circuit 13, an alarm coincidence signal 17 is at a "High" level and the electronic buzzer 18 is driven by the alarm composing circuit 15 and the electronic buzzer driver 16, whereby the alarm sound is generated. At the same time, the "High" level signal 17 is fed to an inverter 19 which inverts the signal to a "Low" level thereby preventing the normal hand stepping pulse from the normal pulse generator 3 from passing through the AND gate 4, and instead the alarm hand stepping pulse produced from the alarm hand stepping pulse generator 14 passes through an AND gate 20 and the OR gate 5, and through the NAND gate 7 or 8 according to the output condition of the TFF 6, and fed to the motor driver 9 or 10, whereby the stepping motor 11 is driven.

Figure 3:
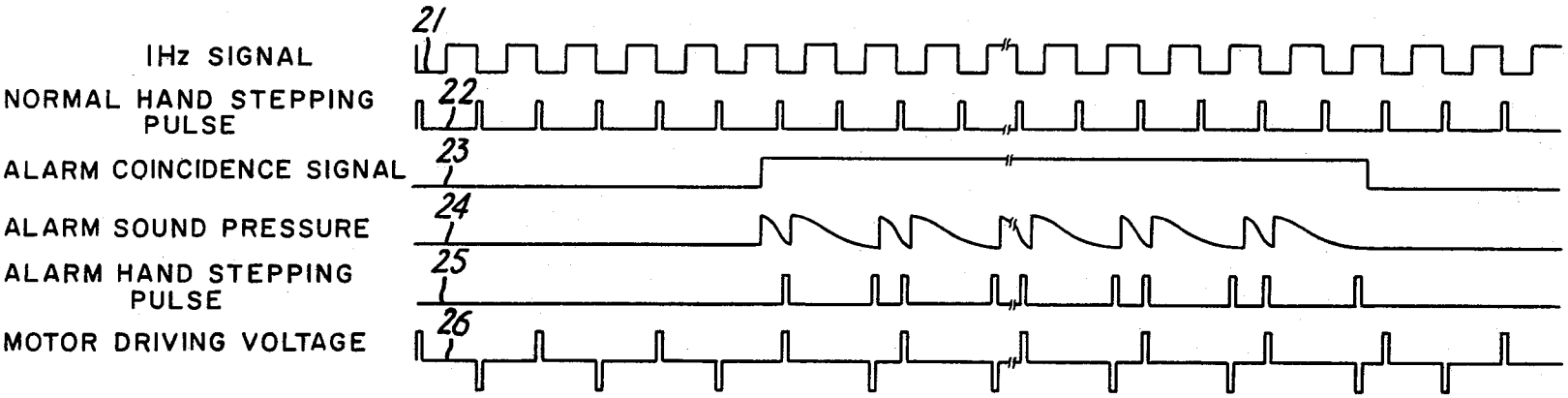
FIG. 3 shows an operation timing chart showing the relation between various signals before and after the coincidence of alarm embodying the present invention.

FIG. 3 shows a timing chart before and after the alarm coincidence signal is changed over from a "Low" level to a "High" level. When an alarm coincidence signal 23 is at a "Low" level, a motor driving voltage 26 is generated by a normal hand stepping pulse 22 which is synchronized with a 1 Hz signal 21 produced from the frequency divider 2. When the alarm coincidence signal 23 is at a "High" level, the motor driving voltage 26 is produced from an alarm hand stepping pulse 25 which is synchronized with an alarm sound pressure wave 24. In the present embodiment, the alarm sound is a repetitive attenuation waveform of 0.5 seconds and 1.5 seconds. If the alarm hand stepping pulse generator 14 is constructed to generate the alarm hand stepping pulse at times where the power consumption of the electronic buzzer is small since the alarm sound pressure is small, the possibility of misoperation caused by conflict or competition between the electronic buzzer driving signal and the hand stepping pulse can be extensively reduced. As shown in FIG. 3, the alarm hand stepping pulses 25 are produced at times when the sound pressure waves 24 are approximately at their lowest or minimum values.

Figure 4:
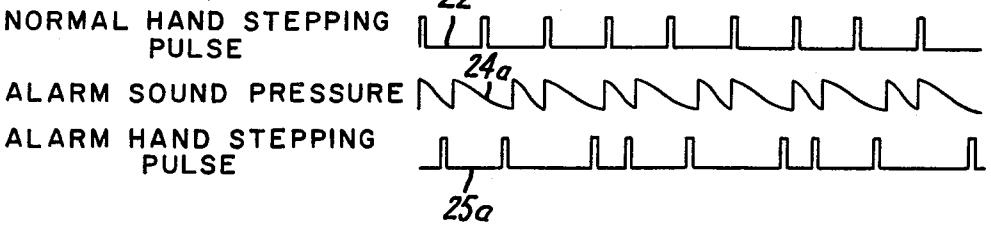
FIG. 4 is a timing chart showing the relationship between the alarm sound pressure and the alarm hand stepping pulse according to another embodiment of the present invention.

FIG. 4 shows a timing chart of another embodiment of the relationship between an alarm sound pressure wave 24*a* and an alarm hand stepping pulse 25*a*, in which the alarm sound pressure, wave 24*a* is a repetitive attenuation waveform of 0.5 seconds and 1 second. In the case the period of repetition is a noninteger such as 1.5 seconds, the alarm hand stepping pulse is generated at times where the sound pressure 24*a* is small, e.g. three alarm hand stepping pulses in three seconds in this case.

Figure 5:
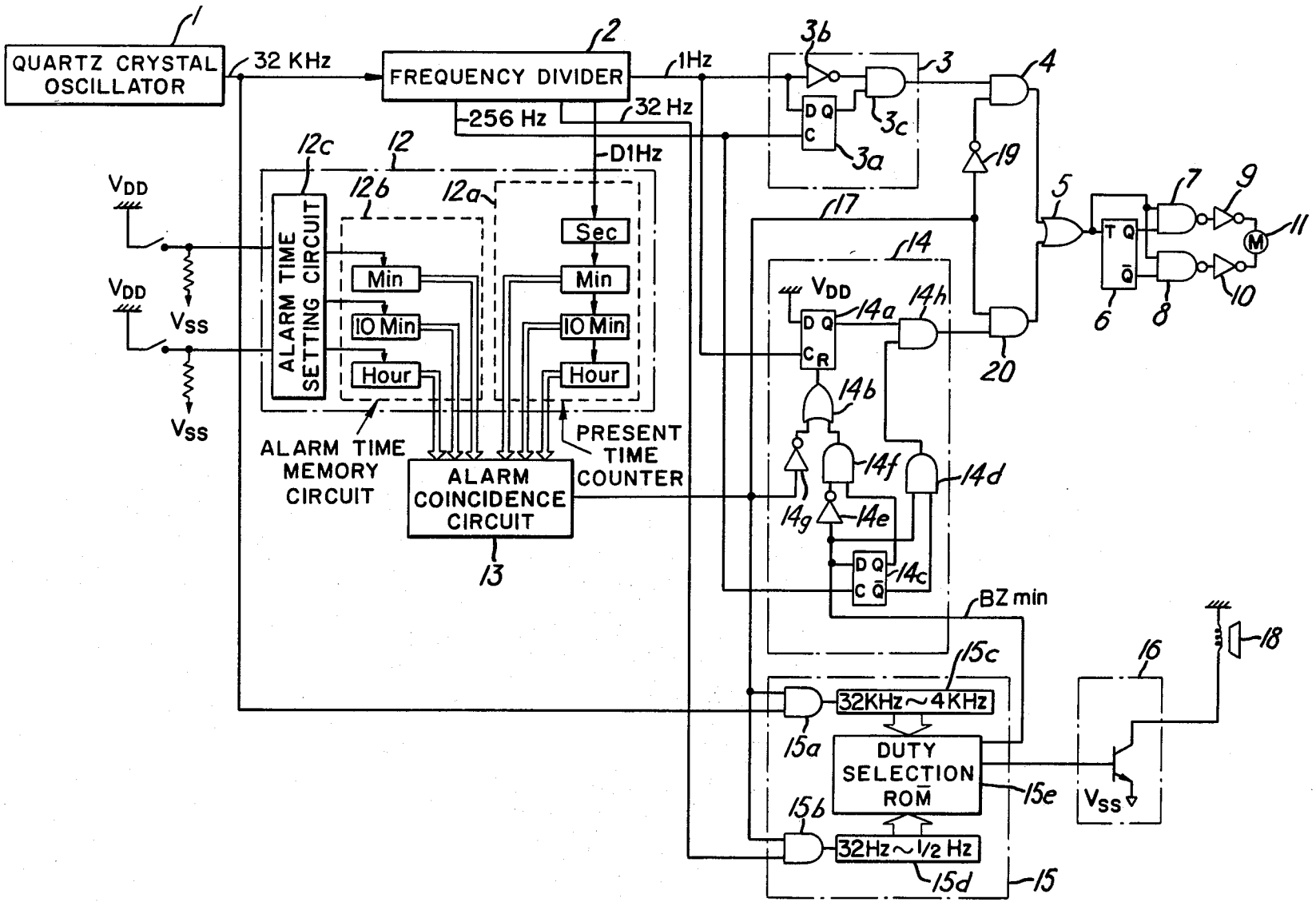
FIG. 5 shows a detailed circuit diagram of an alarm electronic timepiece embodying the present invention.
Figure 6:
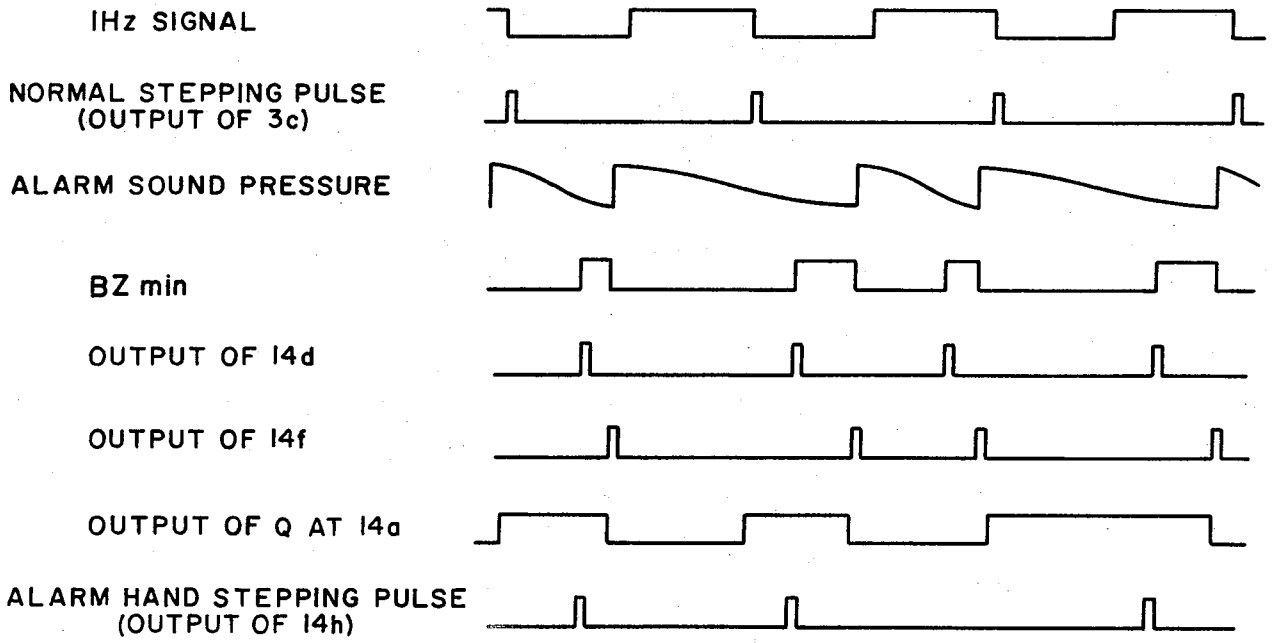
FIG. 6 is a timing chart of FIG. 5.

FIG. 5 shows a detailed circuit of an alarm electronic timepiece according to the present invention and FIG. 6 is a timing chart of FIG. 5.

The time counter 12 comprises mainly a present time counter 12*a*, an alarm time memory circuit 12*b* and an alarm time setting circuit 12*c*. The content of the alarm time memory circuit 12*b* is set from outside the timepiece by the user via the alarm time setting circuit 12*c* in the conventional manner.

Each data of a minute, 10 minutes and hour (including AM and PM) in the present time counter 12*a* and the alarm time memory circuit 12*b* is transferred to the alarm coincidence circuit 13.

The normal hand stepping pulse generator 3 comprises a flip-flop DFF 3*a*, an inverter 3*b* and an AND gate 3*c* and produces a normal hand stepping pulse of 3.9 msec in width synchronized with the falling edge of the 1 Hz signal.

In the alarm hand stepping pulse generator 14, 14*a* denotes a flip-flop DFF for memorizing the falling edge of the 1 Hz signal. The output from an OR gate 14*b* is connected to a reset terminal (R) of the DFF 14*a*. The hand stepping pulse of 3.9 msec in width sychronized with the rising edge of a BZmin signal produced from the alarm composing circuit 15 is generated by a flip-flop DFF 14*c* and an AND gate 14*d*.

On this occasion, if the DFF 14*a* is in a memory state, i.e., if the Q output from the DFF 14*a* is at a "High" level, the hand stepping pulse is produced as an alarm hand stepping pulse via an AND gate 14*h*.

Further the reset pulse which is synchronized with the falling edge of the BZmin signal is applied to the DFF 14*a* via the OR gate 14*b* by the DFF 14*c*, an inverter 14*e* and an AND gate 14*f*.

The alarm composing circuit 15 comprises AND gates 15*a* and 15*b*, a frequency divider 15*c* for diving a 32 KHz signal into a 4 KHz signal, a frequency divider 15*d* for dividing a 32 Hz signal into a signal of $\frac{1}{2}$ Hz, and a ROVE/O/ M 15*e* for selecting a duty cycle of the alarm driving waveform.

When the alarm coincidence signal 17 is at a "High" level, the 32 KHz signal is applied to the frequency divider 15*c* via the AND gate 15*a*, and the 32 Hz signal is applied to the frequency divider 15*d* via the AND gate 15*b*. The outputs from the frequency dividers 15*c* and 15*d* are applied to the duty selection RÕM 15*e*. In this embodiment, the alarm sound pressure for generating the dampened sound is varied by changing the duty of the alarm driving waveform, and the signal BZmin at a "High" level is simultaneously generated during the time interval that the alarm sound pressure is approximately at its lowest or minimum value as shown in FIG. 6.

As illustrated so far, although an accurate second indication can not be expected in the alarm sound generating state since the movement of the second hand synchronized with the alarm sound pressure, the alarm sound generating state continues for one minute at the most and the number of the alarm hand stepping pulses in the alarm sound generating period is equal to the number of the normal hand stepping pulses in the same period. Consequently, no time error is produced in the accumulated time during which the alarm sounds. The coincidence of the alarm can be seen visually from the irregular movement of the second hand, i.e., the second hand moves not in normal one second increments but in synchronism with the alarm sound pressure wave.

According to the present invention, since the hand stepping pulse is synchronized with the alarm sound pressure in the alarm sound generating state, mis-operation or stopping of the motor caused by the conflict or competition between the electronic buzzer driving signal and the hand stepping pulse is significantly reduced whereby a highly reliable alarm electronic timepiece can be provided.

This invention can be easily applied to alarm timepieces in which the alarm sound pressure irregularly varies, such as for a melody, and moreover, the sound is never interrupted while it is being generated. Consequently, an alarm electronic timepiece capable of generating an acoustically excellent sound is provided.

What is claimed is:

1. In an alarm electronic timepiece having a reference time generator, a normal hand stepping pulse generator for producing and applying a normal hand stepping pulse signal to a stepping motor and connected to said reference time generator, a time counter connected to said reference time generator, an alarm coincidence circuit connected to said time counter for producing an output signal at a preselected alarm time, and an electronic buzzer for producing an alarm sound, the improvement comprising: an alarm hand stepping pulse generator for producing and applying an alarm hand stepping pulse signal to said stepping motor instead of said normal hand stepping pulse signal in response to the output signal from said alarm coincidence circuit, and an alarm composing circuit for driving the electronic buzzer and controlling said alarm hand stepping pulse generator to generate said alarm hand stepping pulse approximately at the lowest value portion of the alarm sound pressure of the alarm sound in response to the output signal from said alarm coincidence circuit.

2. In an alarm electronic timepiece having circuitry for producing and applying normal drive pulses to a stepping motor to rotationally drive the stepping motor in a stepwise manner to accordingly drive a set of time-indicating hands to indicate time, alarm circuitry for producing an alarm output signal at preset alarm times, and an electronic buzzer operative when driven to produce an alarm sound pressure wave, the improvement comprising: alarm drive pulse generating means responsive to the alarm output signal for producing and applying alarm drive pulses to the stepping motor instead of the normal drive pulses; and alarm composing circuit means responsive to the alarm output signal for composing a buzzer drive signal corresponding to a predetermined alarm sound pressure wave pattern and applying the same to the electronic buzzer for driving the electronic buzzer so as to produce the predetermined alarm sound pressure wave pattern and for controlling the alarm drive pulse generating means so that the alarm drive pulses are applied to the stepping motor at times when the pressure waves are approximately at their minimum values.

3. An alarm electronic timepiece according to claim 2; wherein the alarm composing circuit means comprises means responsive to the alarm output signal for composing a buzzer drive signal corresponding to an alarm sound pressure wave pattern having a repetitive series of pressure waves at least some of which have different periods; and the alarm drive pulse generating means includes means coacting with the alarm composing circuit means for producing and applying the alarm drive pulses to the stepping motor in synchronization with the alarm sound pressure wave pattern.

4. An alarm electronic timepiece according to claim 3 wherein the alarm drive pulse generating means produces and applies the alarm drive pulses to the stepping motor such that the number of alarm drive pulses applied to the stepping motor during the time that the electronic buzzer produces the alarm sound equals the number of normal drive pulses which would otherwise have been applied to the stepping motor in the absence of the alarm output signal.

* * * * *